US010978038B2

(12) United States Patent
Lee et al.

(10) Patent No.: US 10,978,038 B2
(45) Date of Patent: Apr. 13, 2021

(54) INVISIBLE SOUND BARRIER

(71) Applicant: Toyota Motor Engineering & Manufacturing North America, Inc., Plano, TX (US)

(72) Inventors: Taehwa Lee, Ann Arbor, MI (US); Hideo Iizuka, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 476 days.

(21) Appl. No.: 16/025,630

(22) Filed: Jul. 2, 2018

(65) Prior Publication Data

US 2020/0005756 A1 Jan. 2, 2020

(51) Int. Cl.
*G10K 11/172* (2006.01)
*G10K 11/162* (2006.01)

(52) U.S. Cl.
CPC ..... *G10K 11/172* (2013.01); *G10K 11/162* (2013.01)

(58) Field of Classification Search
CPC ..... G10K 11/172; G10K 11/162
USPC ..... 181/210
See application file for complete search history.

(56) References Cited

U.S. PATENT DOCUMENTS 3,936,035 A * 2/1976 Weimar ..... E01F 8/0035 256/13.1
4,146,113 A * 3/1979 Gavel ..... E01F 8/0035 181/210
4,243,117 A * 1/1981 Warnaka ..... G10K 11/172 181/224
5,756,942 A * 5/1998 Tanaka ..... E01D 19/00 181/207
6,016,887 A * 1/2000 Underhill ..... B32B 5/26 181/210
6,305,492 B1 * 10/2001 Oleiko ..... E01F 8/0017 181/210
6,630,222 B1 * 10/2003 Fay ..... E04B 1/99 160/348

(Continued)

FOREIGN PATENT DOCUMENTS

JP 06316909 A * 6/1994
WO WO-2019021483 A1 * 1/2019 ..... G10K 11/16

OTHER PUBLICATIONS

Banerjee, D. et al, "Invisibility cloak with image projection capability", Sci Rpt, 6, 38965; doi: 10.1038/srep38965 (2016).

(Continued)

*Primary Examiner* — Forrest M Phillips
(74) *Attorney, Agent, or Firm* — Christopher G. Darrow; Darrow Mustafa PC

(57) ABSTRACT

An invisible sound barrier includes a periodic array of spaced apart, columnar unit cells. Each unit cell includes a pair of joined, and inverted, columnar Helmholtz resonators, having neck portions that point in opposite directions. Each of the Helmholtz resonators can be formed of a sound absorbing material and coated with a light reflective material causing light to reflect around the resonators, thereby conferring invisibility. Each of the Helmholtz resonators can alternatively be formed of a light reflecting material, and positioned in between vertical mirrors, with a transparent material filling space between the resonators and the vertical mirrors.

17 Claims, 7 Drawing Sheets

(56) References Cited

U.S. PATENT DOCUMENTS

| | | | | |
|---|---|---|---|---|
| 7,413,053 | B2 * | 8/2008 | Wasif | F23M 20/005 181/210 |
| 7,484,593 | B2 * | 2/2009 | Braun | B29C 70/545 181/203 |
| 8,307,947 | B2 * | 11/2012 | Bussow | F16L 55/0331 181/224 |
| 2005/0103568 | A1 * | 5/2005 | Sapoval | E01F 8/0076 181/293 |
| 2005/0279573 | A1 * | 12/2005 | Ferraiolo | E01F 8/021 181/285 |
| 2017/0227781 | A1 | 8/2017 | Banerjee et al. | |
| 2020/0139902 | A1 * | 5/2020 | Furuzawa | G10K 11/172 |

OTHER PUBLICATIONS

Chen, H. et al., "Broadband polygonal invisibility cloak for visible light," Sci. Rep. 2, 255; DOI:10.1038/srep00255 (2012).

Chen, H. et al., "Ray-Optics Cloaking Devices for Large Objects in Incoherent Natural Light," Nat. Commun.,4:2652 doi: 10.1038/ncomms3652 (2013).

Howell, J.C. et al., "Amplitude-only, passive, broadband, optical spatial cloaking of very large objects," Applied Optics, vol. 53, No. 9, pp. 1958-1963 (2014).

Cheng, Y. et al., "Ultra-sparse metasurface for high reflection of low-frequency sound based on artificial Mie resonances," Nat. Mater., 14, pp. 1013-1020 (2015).

* cited by examiner

FIG. 1C
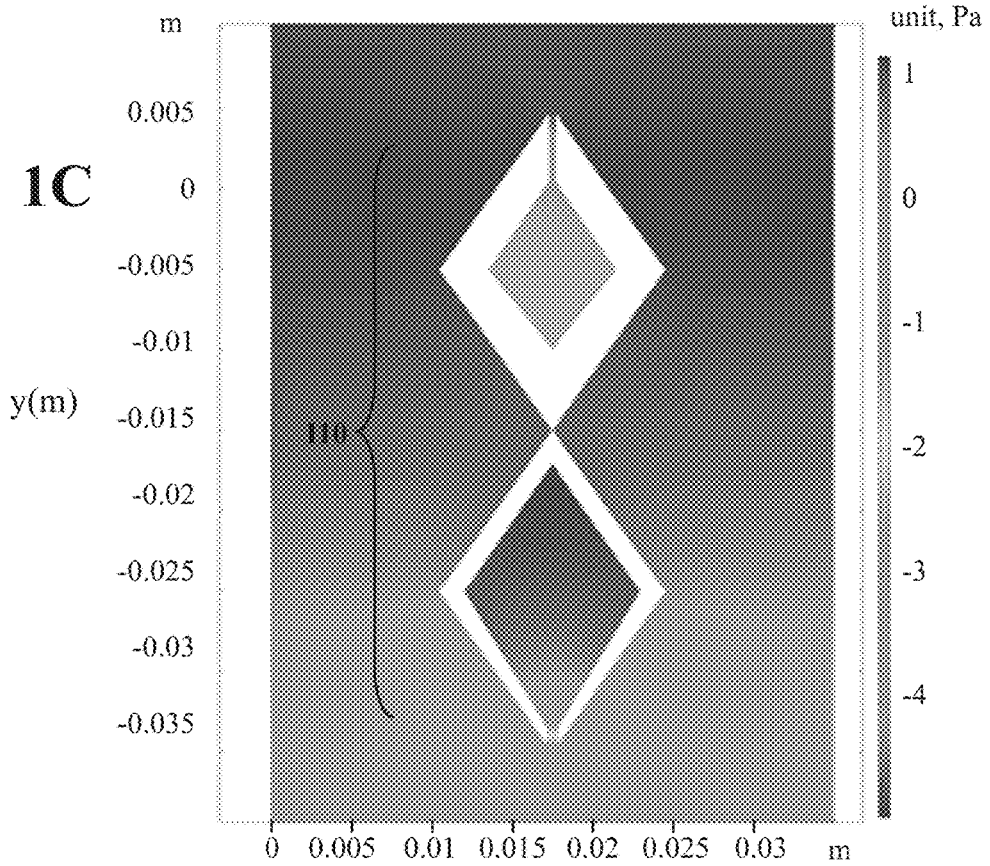
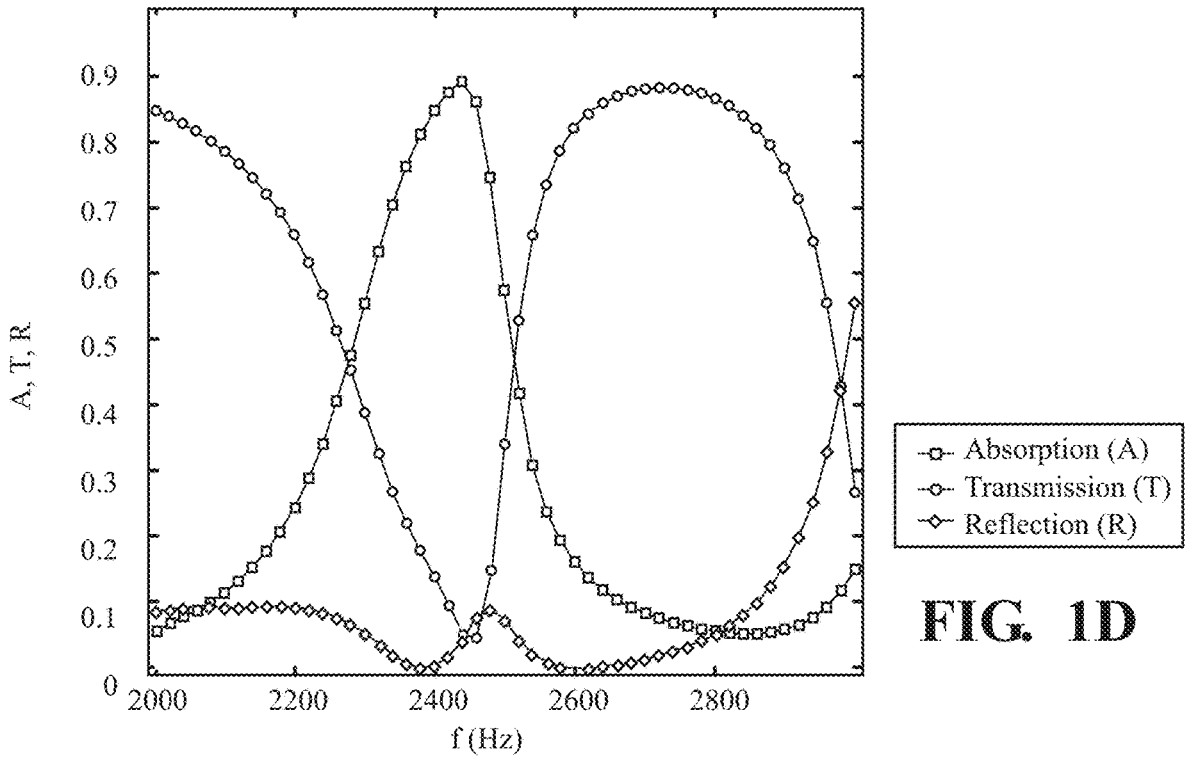
FIG. 1D

INVISIBLE SOUND BARRIER

TECHNICAL FIELD

The present disclosure generally relates to acoustic metamaterials and, more particularly, to acoustic absorption metamaterials that are porous to ambient fluid.

BACKGROUND

The background description provided herein is for the purpose of generally presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

Conventional acoustic barriers are nontransparent, blocking visible light. For example, concrete sound barriers on highway are widely used, but drivers inside their vehicles cannot see beautiful towns beyond such non-transparent walls. To make such conventional barriers transparent would require the near exclusive use of transparent materials in their construction, greatly limiting design possibilities.

Metamaterials formed of arrays of acoustic resonators can be used to absorb incident sound waves. Such materials generally also block visible light and are therefore not transparent. It would be desirable to provide a sound blocking structure that is visually transparent, allowing a user to see through it.

SUMMARY

This section provides a general summary of the disclosure, and is not a comprehensive disclosure of its full scope or all of its features.

In various aspects, the present teachings provide an invisible sound barrier having a one-dimensional periodic array of unit cells spaced apart by a lateral midpoint-to-midpoint distance P, each unit cell having a maximum lateral dimension W, wherein P is greater than W, and each unit cell. Each unit cell includes a first Helmholtz resonator having a hollow columnar structure formed of a solid sound reflecting material and having a cross-sectional shape defining an equilateral parallelogram with an outer dimension and a first internal chamber portion of a first volume. The first Helmholtz resonator also includes a first neck forming an opening on a first side of the first Helmholtz resonator and placing the first internal chamber portion in fluid communication with an ambient environment. Each unit cell also includes a second Helmholtz resonator having a hollow columnar structure formed of a solid sound reflecting material and having a cross-sectional shape defining an equilateral parallelogram with an outer dimension identical to that of the first Helmholtz resonator and a second internal chamber portion of a volume greater than the first volume. The second Helmholtz resonator also includes a second neck, forming an opening on a second side of the second Helmholtz resonator that is opposite the first side of the first Helmholtz resonator, and placing the second internal chamber portion in fluid communication with the ambient environment. Each unit cell further includes a light reflecting material coating outer surfaces of the first and second Helmholtz resonators.

In other aspects, the present teachings provide an invisible sound barrier comprising a one-dimensional periodic array of unit cells spaced apart by a lateral midpoint-to-midpoint distance P, each unit cell having a maximum lateral dimension W, wherein P is greater than W. Each unit cell includes a first Helmholtz resonator having a hollow columnar structure formed of a solid light reflecting material and having a cross-sectional shape defining an equilateral parallelogram with an outer dimension and a first internal chamber portion of a first volume. The first Helmholtz resonator further includes a first neck forming an opening on a first side of the first Helmholtz resonator and placing the first internal chamber portion in fluid communication with an ambient environment. Each unit cell further includes a second Helmholtz resonator having a hollow columnar structure formed of a solid light reflecting material and having a cross-sectional shape defining an equilateral parallelogram with an outer dimension identical to that of the first Helmholtz resonator and a second internal chamber portion of a volume greater than the first volume. The second Helmholtz resonator further includes a second neck, forming an opening on a second side of the second Helmholtz resonator that is opposite the first side of the first Helmholtz resonator, and placing the second internal chamber portion in fluid communication with the ambient environment. Each unit cell further includes first and second planar mirrors spaced laterally apart from the first and second Helmholtz resonators in a direction of periodicity of the one-dimensional periodic array. Each unit cell additionally includes a solid material, transparent to light, filling a volume between: (i) the first and second Helmholtz resonators; and (ii) the first and second planar vertical mirrors.

In still other aspects, the present teachings provide a roadside sound barrier that includes a periodic array of unit cells as described above.

Further areas of applicability and various methods of enhancing the disclosed technology will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description and the accompanying drawings, wherein:

FIG. 1C is a simulated acoustic field around a unit cell of the invisible sound barrier of FIGS. 1A and 1B;

FIG. 1D is a graph of acoustic transmission, reflection, and absorption as a function of frequency for the invisible sound barrier of FIGS. 1A-1C;

It should be noted that the figures set forth herein are intended to exemplify the general characteristics of the methods, algorithms, and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures.

DETAILED DESCRIPTION

The present teachings provide an invisible sound barrier. The disclosed invisible sound barrier. The disclosed barrier provides a structure that reflects or absorbs sound, and is invisible.

The present technology provides a one dimensional array of unit cells, each unit cell including a columnar structure having opposing Helmholtz resonators, configured to absorb acoustic waves. Each Helmholtz resonator has angled walls covered with a light-reflective material. The arrangement of light reflectors causes incident light to ricochet through the structure in a manner that results in invisibility. The structure can be useful for any implementation in which sound absorption and invisibility are desirable, such as a roadside sound barrier that allows drivers to see the space on the other side of the barrier.

Figure 1A:
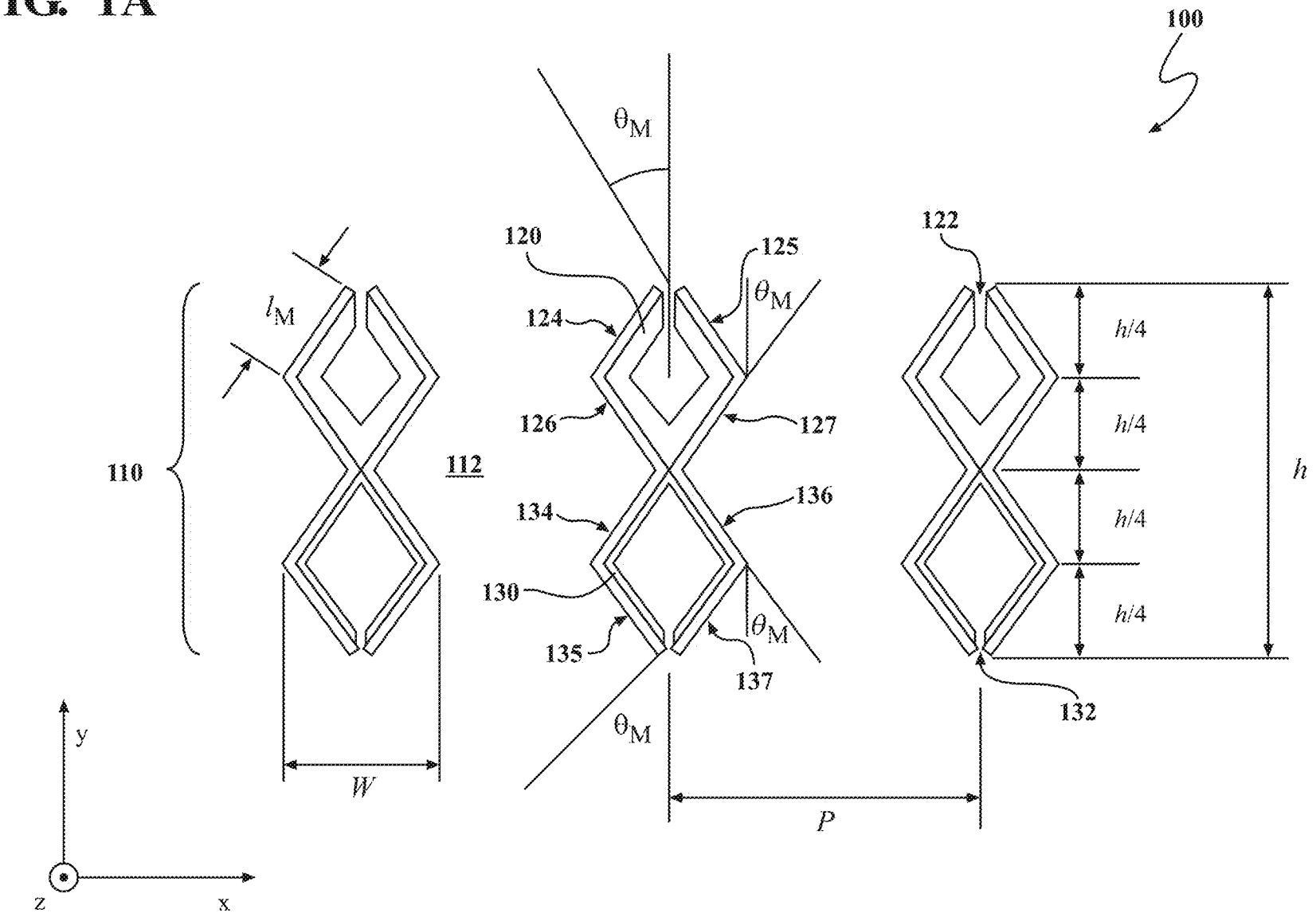
FIG. 1A is a schematic side plan view of a portion of one implementation of an invisible sound barrier having three unit cells.
Figure 1B:
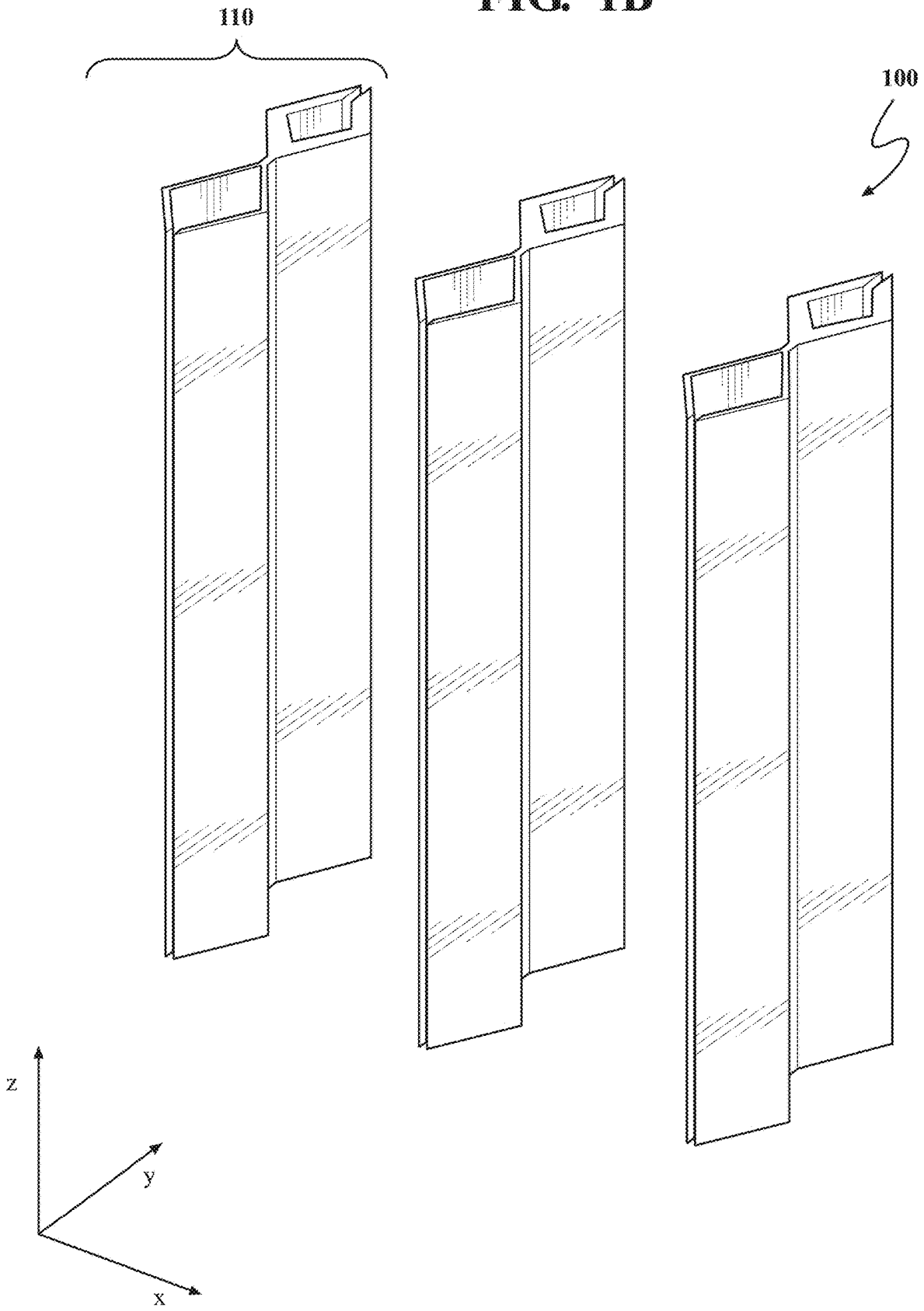
FIG. 1B is a perspective view of the invisible sound barrier of FIG. 1A.

FIGS. 1A and 1B show a side plan view and a perspective view, respectively, of one implementation of an invisible sound barrier 100 according to the present teachings. The invisible sound barrier of FIGS. 1A and 1B includes a one-dimensional array of unit cells 110. Each unit cell 110 includes first and second Helmholtz resonators 120, 130. Each Helmholtz resonator 120 130 has four side walls (not individually labeled in FIGS. 1A and 1B) forming a hollow diamond shape when viewed along the z-axis of FIGS. 1A and 1B. In many implementations, each Helmholtz resonator 120, 130 will have a cross-sectional shape in the x-y plane defining an equilateral parallelogram having an internal chamber. Each Helmholtz resonator 120, 130 of the unit cell 110 has a neck 122, 132 that places the interior of the Helmholtz resonator 120, 130 in fluid communication with the ambient fluid 112 (e.g. air). As shown in FIG. 1A, the first Helmholtz resonator 120 has side walls of a first thickness, while the second Helmholtz resonator has side walls of a second thickness that is less than the first thickness. It is to be understood that neither the first thickness nor the second thickness need necessarily be uniform (i.e. either or both can optionally vary at different points in the side wall), but the first thickness will generally be greater than the second thickness. The first and second Helmholtz resonators will generally have the same outer dimensions, such that the greater wall thickness of the first Helmholtz resonator 120 relative to the second Helmholtz resonator 130 causes the first Helmholtz resonator 120 has a smaller volume of the internal cavity. It will further be understood that the first neck 122 and the second neck 132 will generally be on opposite sides of the first and second Helmholtz resonators 120, 130.

With continued reference to FIGS. 1A and 1B, the equilateral parallelogram defined by a cross-section of either of the first and second Helmholtz resonators generally has a longitudinal axis that is perpendicular to the direction of periodicity of the unit cells 110, and a lateral axis that is parallel to the direction of periodicity of the unit cells. The longitudinal axis passes through two longitudinal vertices of the parallelogram and the lateral axis passes through two lateral vertices of the parallelogram. In some implementations, the two longitudinal vertices of the parallelogram can have an angle, θ, and the two lateral vertices can have an angle, (180°−θ).

The period, P, of the one-dimensional array of unit cells 110 will generally be substantially smaller than the wavelength of the acoustic waves that the invisible sound barrier 100 is designed to absorb. As shown in FIG. 1A, the period can be equated to a center-to-center distance between adjacent unit cells. In different implementations, the period of the periodic array of unit cells 110 will be less than 0.1 or less than 0.01 of the wavelength of the acoustic waves that the invisible sound barrier 100 is designed to absorb, i.e. the resonance frequency/wavelength of the invisible sound barrier 100. For example, in some implementations, the invisible sound barrier 100 can be designed to absorb acoustic waves of a human-audible frequency, having a wavelength within a range of a few tens of millimeters (mm) to a few tens of meters. In such implementations, the periodic array of unit cells 110 can have a period within a range of from about ten or several tens of μm to about one mm. In some implementations, the invisible sound barrier 100 will be designed to absorb acoustic waves in the MHz frequency range, such as those having a wavelength within a range of from about one hundred μm to about two mm. In such implementations, the invisible sound barrier 100 can have a period within a range of about one μm to about one hundred μm. In certain implementations, the invisible sound barrier 100 can have a period within a range of from about one-quarter of its resonance wavelength to about its resonance wavelength (i.e. within a range of about 0.25λ to about λ, where λ is the resonance wavelength of the invisible sound barrier 100).

Each of the first and second Helmholtz resonators 120, 130 is covered on its outer surfaces with a light-reflective material, the light-reflective material forming reflecting outer walls 124, 125, 126, 127, 134, 135, 136, and 137. The reflecting outer walls 124, 125, 126, 127, 134, 135, 136, and 137 will generally have reflectance of at least 0.9 with respect to visible light incident on either of the first or second Helmholtz resonators 120, 130 from the outside. Stated alternatively, the reflecting side walls 124, 125, 126, 127, 134, 135, 136, and 137 need to be reflective in only one direction, i.e. from outside the respective resonator.

In general, each reflecting out wall 124, 125, 126, 127, 134, 135, 136, and 137 has the same length ($I_M$) within the x-y dimensions, where $I_M$ is defined by Equation 1:

$$l_M = \frac{h}{4\cos\theta_M}. \quad (1)$$

where h is the length in the y-dimension of each unit cell 110, $\theta_M$ is the tilting angle of the reflecting outer walls with respect to the y-axis, and which is calculated for a given h and P according to Equation 2:

$$P - \frac{h}{4}\tan\theta_M = \frac{h}{4}\tan 2\,\theta_M. \quad (2)$$

Each unit cell 110 of the periodic array of unit cells 110 will generally have a maximum lateral dimension, or width W. It will be understood that in the one-dimensional array of the invisible sound barrier, the maximum lateral dimension is only in the direction of periodicity (e.g. the x-dimension), and not in the elongated direction (e.g. the z-dimension). The periodic array of unit cells 110 is further characterized by a fill factor equal to W/P. In general, the fill factor will be 0.5 or less. In some implementations, the fill factor will be 0.25 (i.e. 25%) or less. It will be appreciated that the resonant frequency of the periodic phase—i.e. the periodic array of unit cells 110—is substantially determined by the fill factor of the periodic array of unit cells 110; the ratio of width to period of unit cells 110. As noted above, the period of the periodic array of unit cells 110 is smaller than the wavelength corresponding to the desired resonance frequency (period <wavelength). At the same time, in many implementations the period and width of unit cells 110 will be chosen so that the periodic array of unit cells 110 has a fill factor of at least 0.2 (i.e. 20%).

It will further be understood that interior chamber of each of the first and second Helmholtz resonators defines a volume, corresponding to the volume of ambient fluid 112 that can be held in the chamber. In general, the volume of the interior chamber of the first Helmholtz resonator 120 will be less than the volume of the interior chamber of the second Helmholtz resonator 130. It will further be understood that each of the first and second necks 122, 132 has a length. In general, the length of the first neck 122 will be greater than the length of the second neck 132. Thus, the first Helmholtz resonator 120 generally has a longer neck and a smaller (lower volume) interior chamber does the second Helmholtz resonator 130.

The first and second Helmholtz resonators 120, 130, exclusive of the reflecting outer walls 124, 125, 126, 127, 134, 135, 136, and 137 will typically be formed of a solid, sound reflecting material. In general, the material or materials of which the first and second Helmholtz resonators 120, 130 are formed will have acoustic impedance higher than that of ambient fluid 112. Such materials can include a thermoplastic resin, such as polyurethane, a ceramic, or any other suitable material. The resonator pair has the same resonance frequency, determined with the neck length (L), neck area (S), cavity volume (V) through $f \sim (S*L^{-1}*V^{-1})^{1/2}$. Sound is blocked by the absorption of the structure (close to unity around resonance). The first resonator has a longer neck and smaller cavity compared to the second resonator. The incident acoustic energy is dissipated to heat in the neck via viscous loss. The first resonator has higher viscous loss than the second resonator because of its long neck (loss proportional to L). Moreover, external sidewalls of the structure are coated with multiple mirrors, rendering the whole structure invisible. It will be understood that the first resonator has the same resonance frequency as the second resonator, i.e., $S_1/(L_1V_1)=S_2/(L_2V_2)$. For $L_1>L_2$ and $S_1 \sim S_2$, the volume should be $V_1<V_2=S_2V_1L_1(S_1L_2) \sim V_1L_1/L_2$.

FIG. 1C shows a simulated acoustic field for a unit cell 110 of the invisible sound barrier 100 when impinged by incident acoustic wave propagating to first reach the first Helmholtz resonator 120. The results show that acoustic energy is concentrated around the necks 122, 132. FIG. 1D shows the acoustic performance of the invisible sound barrier of FIGS. 1A and 1B, with transmission, reflection, and absorption. It can be observed that the structure shows high absorption at the resonance frequency (in this case, about 2500 Hz). As referenced above, the resonance frequency can be altered by varying the dimensions of the first and second Helmholtz resonators 120, 130.

FIG. 1C shows acoustic pressure distribution at the resonance frequency (2.5 kHz) for an invisible sound barrier of FIGS. 1A and 1B having a fill factor of 25%, with acoustic waves approaching from the top of the figure. FIG. 1D is a graph of acoustic transmission, reflection, and absorption as a function of frequency for the same invisible sound barrier 100. It will be observed that the invisible sound barrier 100 demonstrates strong acoustic absorption at the resonance frequency—in this example centered at 2.5 kHz, and allows very low transmission at the resonance frequency. It will further be observed that reflection is very low at the resonance frequency, such that nearly all of the sound is absorbed at the resonance frequency. As can be seen from the schematic image of FIG. 1C, acoustic energy is concentrated primarily around the neck 122 of the first Helmholtz resonators 120, but also significantly around the neck 132 of the second Helmholtz resonator 130. This result highlights the contribution that both Helmholtz resonators 120, 130 make to the absorption properties of the invisible sound barrier 100 when operating in absorption mode.

Figure 2A:
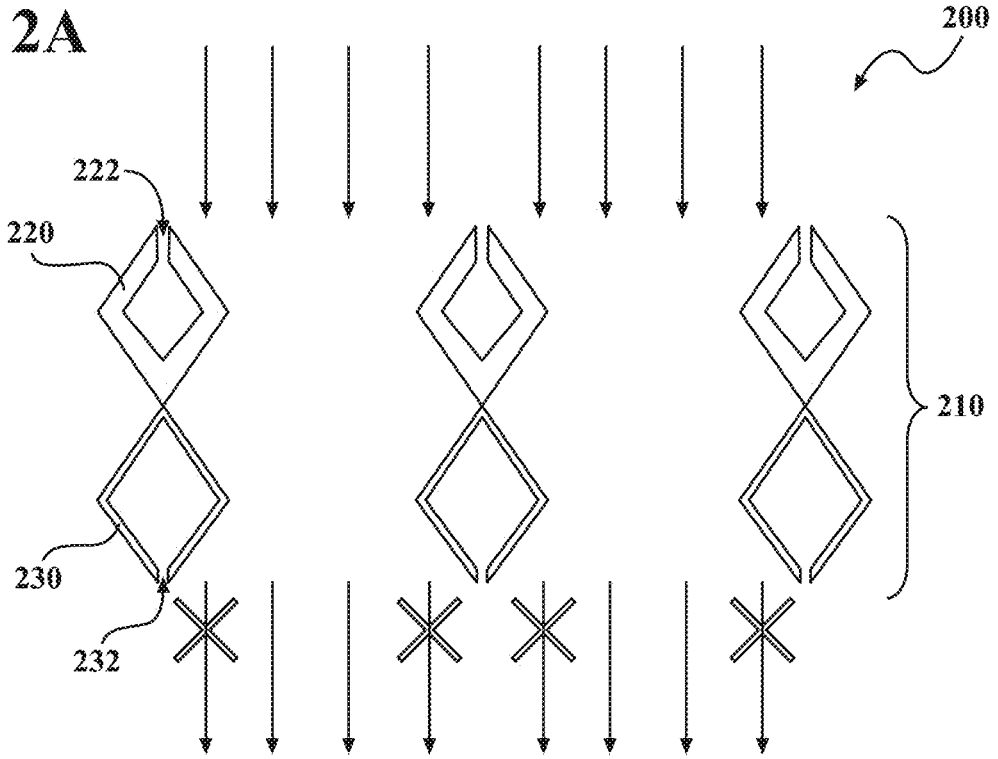
FIG. 2A is a schematic view of the interaction of normal incident light with a comparative, visible sound barrier, similar to the invisible sound barrier of FIG. 1A but lacking reflective outer walls.
Figure 2B:
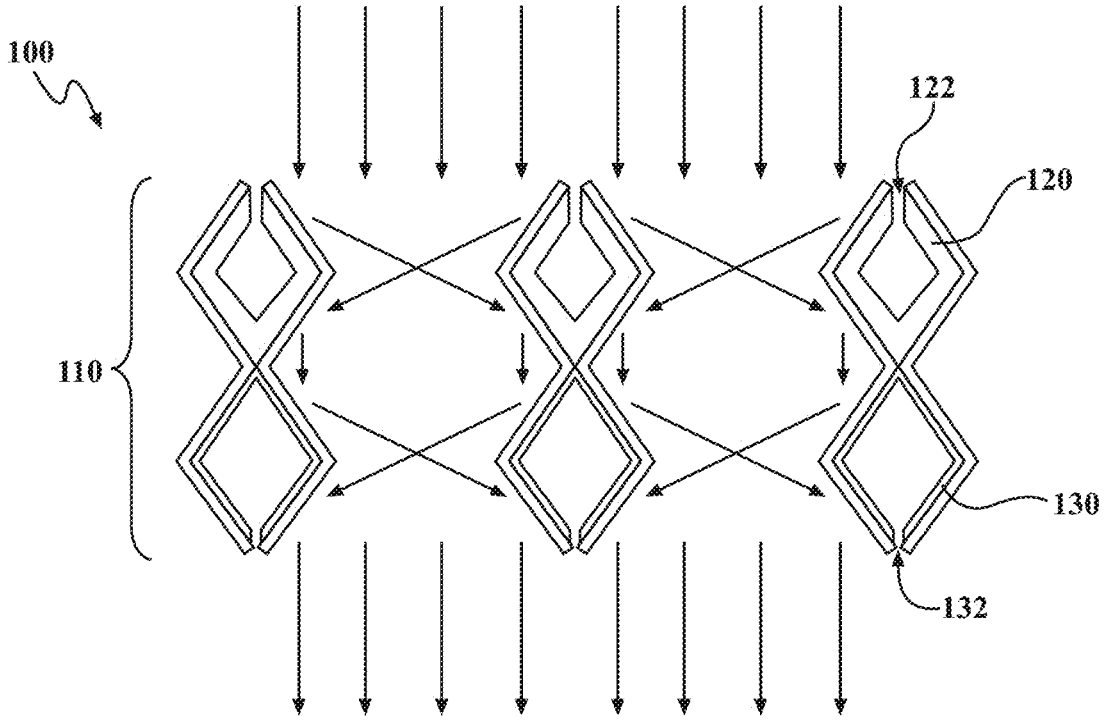
FIG. 2B is a schematic view of the interaction of normal incident light with the invisible sound barrier of FIG. 1A.
Figure 2C:
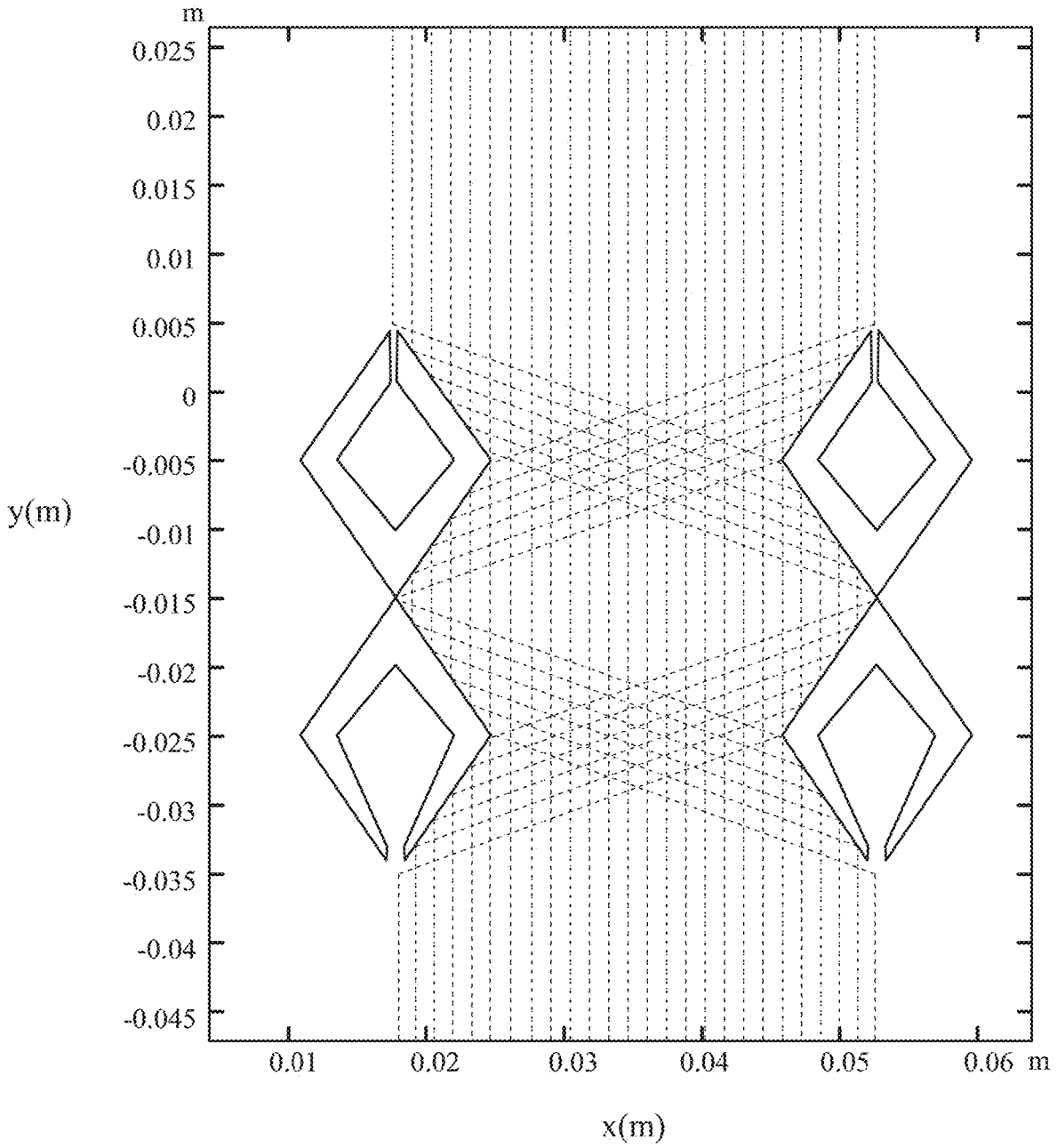
FIG. 2C is a simulation of ray tracing as normal incident light interacts with a unit cell of the invisible sound barrier of FIG. 1A.

FIG. 2A shows a comparative, visible sound barrier 200, that is identical to the invisible sound barrier 100 of FIG. 1A, but lacks the reflective outer walls 124, 125, 126, 127, 134, 135, 136, and 137. Normal incident light that strikes the unit cells 210 of the comparative, visible sound barrier 200 are blocked (e.g. reflected or absorbed) by the visible unit cells 210, thereby causing the visible unit cells 200 to be visually observable. Such blockage of light is indicated in FIG. 2A by the relevant light beams, indicated by vertical arrows, being crossed out, showing that they do not pass through the visible sound barrier 200. FIG. 2B shows an equivalent view of invisible sound barrier 100. As shown in FIG. 2B, normal incident light is reflected between reflective side walls in such a way that it emerges from the light transmission side (i.e. the bottom side, according to the view of FIG. 2B) in exactly the same fashion as it would if the invisible sound barrier 100 were not present. Thus, when the invisible sound barrier 100 is viewed from a normal angle, as according to FIG. 2B, it will be invisible to the observer, as light is reflected around the unit cells 110 so that they cannot be seen. It will be understood that when the invisible sound barrier 100 is viewed at different angles, it may be partially visible. FIG. 2C shows a simulation of ray tracing on a portion of an invisible sound barrier 100 having two adjacent unit cells 110, providing additional detail on the series of reflections that lead to invisibility of the barrier 100.

Figure 3A:
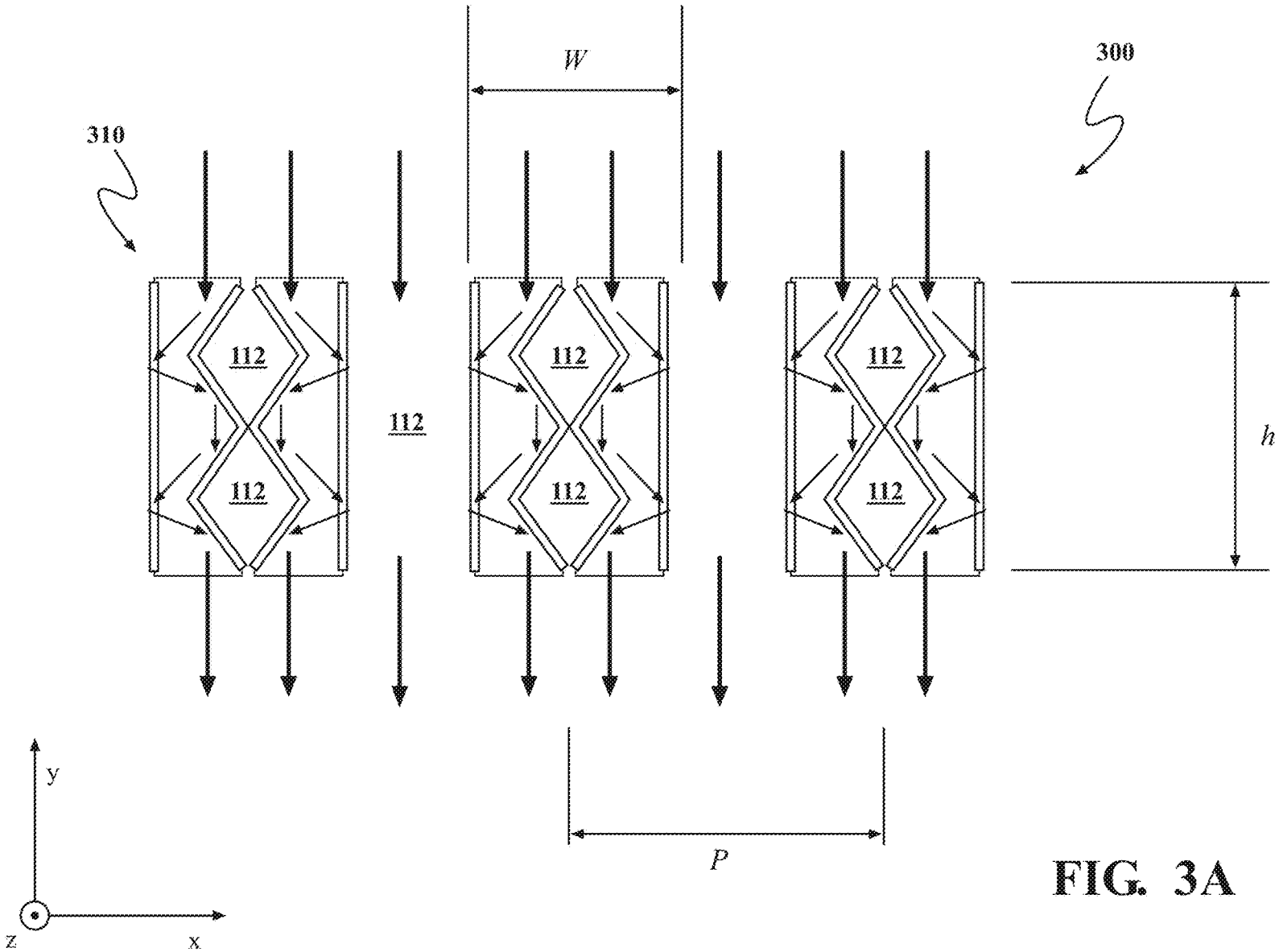
FIG. 3A is a schematic side plan view of a portion of an alternative implementation of an invisible sound barrier having three unit cells.
Figure 3B:
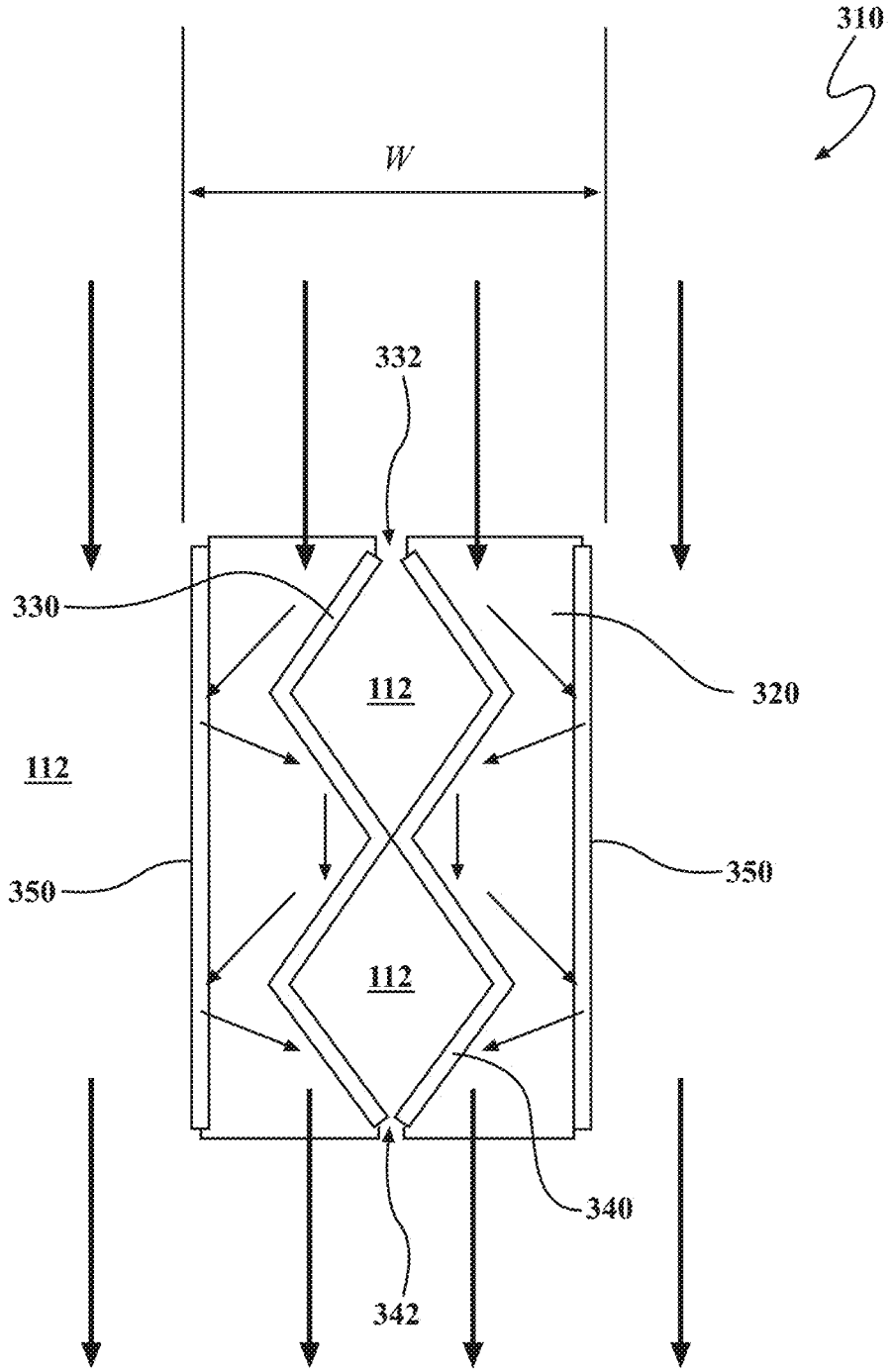
FIG. 3B is a schematic side view of a unit cell of the alternative invisible sound barrier of FIG. 3A.

FIG. 3A shows an alternative implementation of an invisible sound barrier 300 of the present teachings, also having a one dimensional array of unit cells 310. FIG. 3B shows a single unit cell 310 of the invisible sound barrier 300 of FIG. 3A. The invisible sound barrier 300 of FIGS. 3A and 3B includes eight reflective walls identical to the outer reflective walls 124, 125, 126, 127, 134, 135, 136, and 137 of the barrier 100 of FIG. 1A, and thereby forming first and second Helmholtz resonators 330, 340 having a cross-sectional diamond shape in the x-y plane, and being elongated in the z-dimension as in the case of FIGS. 1A and 1B. In many implementations, each of the first and second Helmholtz resonators 330, 340 will have a cross-sectional shape in the x-y plane defining an equilateral parallelogram having an internal cavity. The Helmholtz resonators 330, 340 of FIGS. 3A and 3B have necks 332, 342 as above, but do not have any solid material in the interior—instead ambient fluid (e.g. air) that is in fluid communication with the resonator interiors is in direct contact with inner surfaces of the reflective walls.

Adjacent to, and spaced apart from, each pair of opposing Helmholtz resonators 330, 340 is a vertical mirror 350. The vertical mirror 350 has similar length in the y and z-dimensions to the pair of Helmholtz resonators 330, 340, and served to help reflect light around the pair of Helmholtz resonators 330, 340 in a manner similar to that discussed above with reference to FIGS. 2B and 2C. A transparent solid 320, such as a glass or transparent plastic, fills the space between each pair of Helmholtz resonators 330, 340 and the adjacent vertical mirrors 350.

The length of each reflective wall is calculated according to Equation 1, above, where the value h is calculated according to Equation 3, which is a modified version of Equation 2, above:

$$w - \frac{h}{4}\tan\theta_M = \frac{h}{4}\tan 2\,\theta_M. \quad 3$$

where w is the width of the unit cell 310.

It will be appreciated that a roadside sound barrier can be formed of any invisible sound barrier of the present teachings, including the exemplary sound barriers 100 and 300. In such implementations, the column-like unit cells 110 or 310 can be positioned on the side of a roadway to absorb sound emitted by passing vehicles. Such roadside sound barriers would be invisible to drivers passing by, such that scenario adjacent to the road would be viewable by the drivers without visual obstruction.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure, and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. An invisible sound barrier comprising a one-dimensional periodic array of unit cells spaced apart by a lateral midpoint-to-midpoint distance P, each unit cell having a maximum lateral dimension W, wherein P is greater than W, and each unit cell comprising:

a first Helmholtz resonator having:

a hollow columnar structure formed of a solid sound reflecting material and having a cross-sectional shape defining an equilateral parallelogram with an outer dimension and a first internal chamber portion of a first volume; and a first neck forming an opening on a first side of the first Helmholtz resonator and placing the first internal chamber portion in fluid communication with an ambient environment; and a second Helmholtz resonator having:

a hollow columnar structure formed of a solid sound reflecting material and having a cross-sectional shape defining an equilateral parallelogram with an outer dimension identical to that of the first Helmholtz resonator and a second internal chamber portion of a volume greater than the first volume; and a second neck, forming an opening on a second side of the second Helmholtz resonator that is opposite the first side of the first Helmholtz resonator, and placing the second internal chamber portion in fluid communication with the ambient environment; and a light reflecting material coating outer surfaces of the first and second Helmholtz resonators.

2. The invisible sound barrier as recited in claim 1, wherein each of the first and second Helmholtz resonators comprises:

two longitudinal vertices having an angle, θ, and positioned along a longitudinal axis perpendicular to a direction of periodicity of the one dimensional periodic array; and two lateral vertices having an angle 2θ, and positioned along a lateral axis perpendicular to a direction of periodicity of the one dimensional periodic array.

3. The invisible sound barrier as recited in claim 1, wherein W is less than or equal to 0.5 P.

4. The invisible sound barrier as recited in claim 1, wherein W is less than or equal to 0.25 P.

5. The invisible sound barrier as recited in claim 1, wherein a length of the first neck is greater than a length of the second neck.

6. The invisible sound barrier as recited in claim 1, wherein P is within a range of from about one-quarter of the resonance wavelength of the barrier to about the resonance wavelength of the barrier.

7. An invisible sound barrier comprising a one-dimensional periodic array of unit cells spaced apart by a lateral midpoint-to-midpoint distance P, each unit cell having a maximum lateral dimension W, wherein P is greater than or equal to W, and each unit cell comprising:

a first Helmholtz resonator having:

a hollow columnar structure formed of a solid light reflecting material and having a cross-sectional shape defining an equilateral parallelogram with an outer dimension and a first internal chamber portion of a first volume; and a first neck forming an opening on a first side of the first Helmholtz resonator and placing the first internal chamber portion in fluid communication with an ambient environment; and a second Helmholtz resonator having:

a hollow columnar structure formed of a solid light reflecting material and having a cross-sectional shape defining an equilateral parallelogram with an outer dimension identical to that of the first Helmholtz resonator and a second internal chamber portion of a volume greater than the first volume; and a second neck, forming an opening on a second side of the second Helmholtz resonator that is opposite the first side of the first Helmholtz resonator, and placing the second internal chamber portion in fluid communication with the ambient environment; and first and second planar mirrors spaced laterally apart from the first and second Helmholtz resonators in a direction of periodicity of the one-dimensional periodic array; and a solid material, transparent to light, filling a volume between:

the first and second Helmholtz resonators; and the first and second planar mirrors.

8. The invisible sound barrier as recited in claim 7, wherein each of the first and second Helmholtz resonators comprises:

two longitudinal vertices having an angle, θ, and positioned along a longitudinal axis perpendicular to a direction of periodicity of the one dimensional periodic array; and two lateral vertices having an angle (180°−θ), and positioned along a lateral axis perpendicular to a direction of periodicity of the one dimensional periodic array.

9. The invisible sound barrier as recited in claim 8, wherein each of the first and second planar mirrors is perpendicular to the direction of periodicity of the one-dimensional periodic array.

10. The invisible sound barrier as recited in claim 7, wherein the solid material, transparent to light, comprises glass.

11. The invisible sound barrier as recited in claim 8, wherein the solid material, transparent to light, comprises a transparent plastic.

12. The invisible sound barrier as recited in claim 7, wherein W is less than or equal to 0.5 P.

13. The invisible sound barrier as recited in claim 7, wherein W is less than or equal to 0.25 P.

14. The invisible sound barrier as recited in claim 7, wherein a length of the first neck is greater than a length of the second neck.

15. The invisible sound barrier as recited in claim 7, wherein P is within a range of from about one-quarter one-quarter of the resonance wavelength of the barrier to about the resonance wavelength of the barrier.

16. A roadside sound barrier comprising:

a one-dimensional periodic array of unit cells spaced apart by a lateral midpoint-to-midpoint distance P, each unit cell having a maximum lateral dimension W, wherein P is greater than W, and each unit cell comprising:

a first Helmholtz resonator having:

a hollow columnar structure formed of a solid sound reflecting material and having a cross-sectional shape defining an equilateral parallelogram with an outer dimension and a first internal chamber portion of a first volume; and a first neck forming an opening on a first side of the first Helmholtz resonator and placing the first internal chamber portion in fluid communication with an ambient environment; and a second Helmholtz resonator having:

a hollow columnar structure formed of a solid sound reflecting material and having a cross-sectional shape defining an equilateral parallelogram with an outer dimension identical to that of the first Helmholtz resonator and a second internal chamber portion of a volume greater than the first volume; and a second neck, forming an opening on a second side of the second Helmholtz resonator that is opposite the first side of the first Helmholtz resonator, and placing the second internal chamber portion in fluid communication with the ambient environment; and a light reflecting material coating outer surfaces of the first and second Helmholtz resonators.

17. The roadside sound barrier as recited in claim 16, wherein each of the first and second Helmholtz resonators comprises:

two longitudinal vertices having an angle, θ, and positioned along a longitudinal axis perpendicular to a direction of periodicity of the one dimensional periodic array; and two lateral vertices having an angle (180°−θ), and positioned along a lateral axis perpendicular to a direction of periodicity of the one dimensional periodic array.

* * * * *